US009237778B2

(12) United States Patent
Cook et al.

(10) Patent No.: US 9,237,778 B2
(45) Date of Patent: Jan. 19, 2016

(54) CYCLING SHOE

(75) Inventors: Robert A. L. Cook, Aptos, CA (US); Carl Darius Bird, Aptos, CA (US)

(73) Assignee: SPECIALIZED BICYCLE COMPONENTS, INC., Morgan Hills, CA (US)

( * ) Notice: Subject to any disclaimer, the term of this patent is extended or adjusted under 35 U.S.C. 154(b) by 480 days.

(21) Appl. No.: 13/532,648

(22) Filed: Jun. 25, 2012

(65) Prior Publication Data

US 2013/0340292 A1 Dec. 26, 2013

(51) Int. Cl.

| | |
|---|---|
| ***A43B 5/00*** | (2006.01) |
| ***A43B 5/14*** | (2006.01) |
| ***A43B 23/00*** | (2006.01) |
| ***A43B 9/00*** | (2006.01) |
| ***A43C 11/14*** | (2006.01) |
| *A44B 13/00* | (2006.01) |

(52) U.S. Cl.

CPC ... *A43B 5/14* (2013.01); *A43B 5/00* (2013.01); *A43B 9/00* (2013.01); *A43B 23/00* (2013.01); *A43C 11/1493* (2013.01); *A44B 13/00* (2013.01); *Y10T 24/3484* (2015.01)

(58) Field of Classification Search

CPC ..... A43B 5/00; A43B 13/00; A43B 23/00
USPC ..... 36/50.1, 50.5, 83, 131, 132, 118.5, 114
See application file for complete search history.

(56) References Cited

U.S. PATENT DOCUMENTS

| | | | | |
|---|---|---|---|---|
| 1,159,397 | A * | 11/1915 | Leonard | 24/712.7 |
| 4,712,319 | A * | 12/1987 | Goria | 36/137 |
| 4,876,808 | A * | 10/1989 | Hsieh | 36/131 |
| 5,158,428 | A * | 10/1992 | Gessner et al. | 24/712.9 |
| 5,341,583 | A * | 8/1994 | Hallenbeck | 36/50.1 |
| 5,566,474 | A * | 10/1996 | Leick et al. | 36/50.1 |
| 6,119,318 | A | 9/2000 | Maurer | |
| 6,305,103 | B1 * | 10/2001 | Camargo | 36/50.1 |
| 6,324,774 | B1 * | 12/2001 | Zebe, Jr. | 36/50.1 |
| 6,412,151 | B1 * | 7/2002 | Rowland | 24/598.4 |
| D462,163 | S | 9/2002 | Zebe, Jr. | |
| 6,477,793 | B1 | 11/2002 | Pruitt et al. | |
| 6,568,103 | B2 * | 5/2003 | Durocher | 36/50.1 |
| 6,922,917 | B2 * | 8/2005 | Kerns et al. | 36/50.1 |
| 8,075,456 | B2 * | 12/2011 | Fugitt | 482/92 |
| 8,516,662 | B2 * | 8/2013 | Goodman et al. | 24/68 SK |
| 2002/0083621 | A1 * | 7/2002 | Durocher | 36/50.5 |
| 2002/0108273 | A1 * | 8/2002 | Yuan | 36/136 |
| 2007/0060454 | A1 * | 3/2007 | Vogel | 482/121 |

(Continued)

OTHER PUBLICATIONS www.triathletesdiary.com, "Semi-flying mounts & flying dismounts", Jul. 4, 2011 (Refer as Triathletes).*

(Continued)

*Primary Examiner* — Shaun R Hurley

*Assistant Examiner* — Bao-Thieu L Nguyen

(74) *Attorney, Agent, or Firm* — Knobbe Martens Olson & Bear LLP

(57) ABSTRACT

A cycling shoe can include a hook that, when used together with another device, such as with a rubber band, can position the shoe on a bicycle in a desired position. The shoes can be clipped into pedals on the bicycle, and the hook and rubber band can be used to position the shoes and crank arms of the bicycle in the position desired by the user. The hook can be on the arch side of the shoe. The hook can be separate from the tightening system.

9 Claims, 8 Drawing Sheets

(56) References Cited

U.S. PATENT DOCUMENTS

| | | | | |
|---|---|---|---|---|
| 2009/0229146 | A1* | 9/2009 | Yanke et al. | 36/131 |
| 2010/0319216 | A1* | 12/2010 | Grenzke et al. | 36/54 |
| 2011/0056094 | A1* | 3/2011 | Yanke et al. | 36/131 |
| 2011/0258885 | A1* | 10/2011 | Rutherford | 36/136 |
| 2012/0227287 | A1* | 9/2012 | Czan | 36/131 |
| 2013/0067767 | A1* | 3/2013 | Casto | 36/85 |

OTHER PUBLICATIONS

2010 Specialized Trivent Triathlon Shoe.

* cited by examiner

CYCLING SHOE

CROSS-REFERENCE TO RELATED APPLICATIONS

N/A.

BACKGROUND OF THE INVENTION

1. Field of the Invention

The present invention relates generally to the field of cycling footwear, and more particularly to a cycling shoe utilized in a multi-sport event, such as a triathlon cycling shoe.

2. Description of the Related Art

A triathlon is a multi-sport event involving the completion of three sequential endurance events. While many variations of the sport exist, triathlon, in its most popular form, involves swimming, cycling, and running in immediate succession over various distances. Triathletes compete for fastest overall course completion time, including timed transitions between the individual swim, bike, and run components. Other multi-sport events include dualthlons, which include one or more running and cycling stages, and off-road triathlons with a swim stage, mountain-biking stage, and a trail-running stage. The order of the various stages may depend on the particular event.

Many multi-sport events, such as those discussed above, include a transition between two different sports. For example, the transition can involve discarding gear necessary to perform one sport and obtaining gear necessary for the next sport. In some instances, multi-sport events may include little to no transition. The time taken during the transitions between the different sports generally counts against the overall time and can be a significant factor in the overall results. Many systems and methods are used to decrease these transition times.

SUMMARY OF THE INVENTION

There exists a continuing need to develop systems and methods to decrease transition time, facilitate easier transitions, etc. For example, a cycling shoe can include a hook on the shoe which can be used together with another device, such as with a rubber band, to position the shoes on a bicycle in a desired position to make for a better, quicker, and/or easier transition. The shoes can be clipped into pedals on the bicycle, and the hook and rubber band can be used to position the shoes and crank arms of the bicycle in the position desired by the user.

In some embodiments, a clipless triathlon cycling shoe can have a single hook on the arch side of the shoe, the hook being separate from the tightening system. In some embodiments, the shoe does not have laces for tying in a knot but rather has a buckle, VELCRO® (hook and loop fasteners) strap(s), a self-contained band and reel system, etc. The hook can allow the user to attach a rubber band to the shoe and to the bicycle to position the shoes as desired.

A clipless cycling shoe for use in a multi-sport event can have an arch side, an outer side, and a tightening system configured for bringing the arch side of the shoe in closer proximity to the outer side of the shoe by tightening the shoe around a foot of the user, the tightening system not including laces for tying in a knot. A single hook can be located on the arch side of the shoe, the hook being separate from and spaced from the tightening system. The hook can be configured to engage a rubber band attached to a bicycle, the rubber band being separate from the tightening system. In some embodiments, the hook can have a sharpened edge.

A method of positioning a pair of clipless cycling shoes on a bicycle can include clipping in a first cleat of a first clipless cycling shoe into a first pedal; clipping in a second cleat of a second clipless cycling shoe into a second pedal; securing a rubber band to the bicycle; and engaging a hook positioned on an arch side of the first clipless cycling shoe with the rubber band.

BRIEF DESCRIPTION OF THE DRAWINGS

These and other features, aspects and advantages are described below with reference to the drawings, which are intended to illustrate but not to limit the invention. In the drawings, like reference characters denote corresponding features consistently throughout similar embodiments.

DETAILED DESCRIPTION OF THE PREFERRED EMBODIMENT

Figure 2:
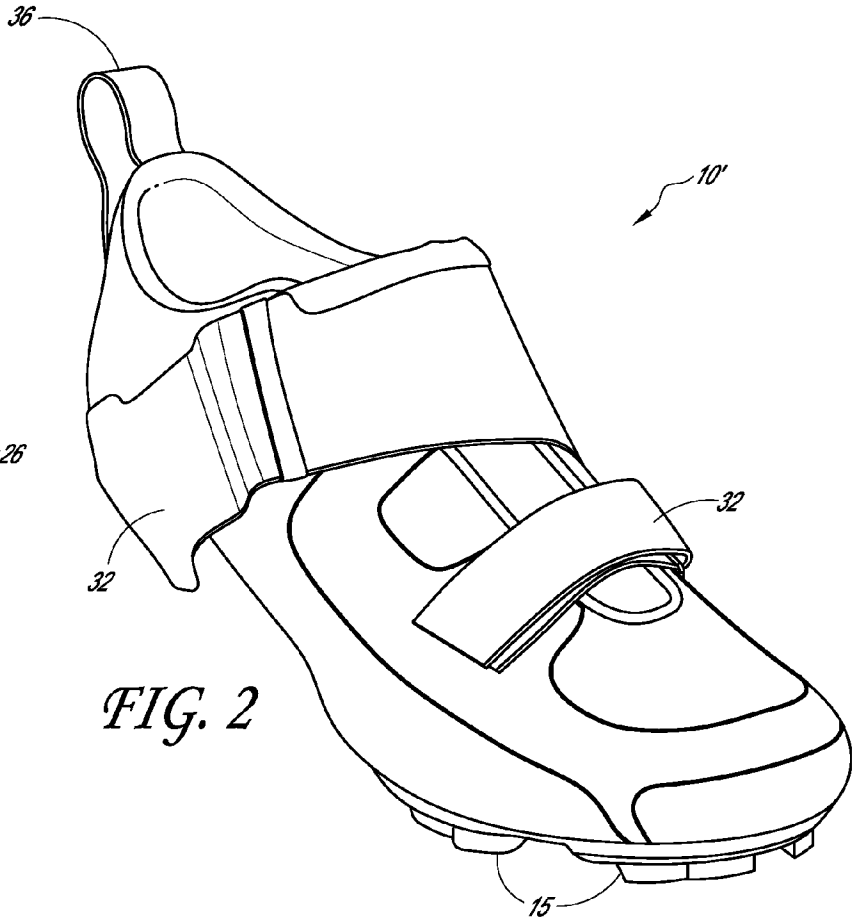
FIGS. 1 and 2 show two different triathlon cycling shoes.

Though many multi-sport events exist, the multi-sport cycling shoe will be discussed with reference to triathlons solely for ease of explanation. It will be understood that features of the multi-sport cycling shoes discussed herein could be used for any multi-sport event that utilizes a bicycle.

Triathlons generally include five sequential sections: 1) the swimming stage, 2) the first transition (T1), 3) the cycling stage, 4) the second transition (T2), and 5) the running stage, after which the triathlon is completed. The swimming stage usually proceeds around a series of marked buoys before athletes exit the water near the transition area. Racers exit out of the water, enter the transition area, and change from their swim gear and into their cycling gear. Competition and pressure for faster times have led to the development of specialized triathlon clothing that is adequate for both swimming and cycling, allowing many racers to have a transition that consists of only removing their wetsuit and goggles and pulling on a helmet and cycling shoes. In some cases, racers leave their cycling shoes attached to their bicycle pedals and slip their feet into them while riding, after they have mounted the bicycle and are pedaling away from the transition area. Some triathletes don't wear socks, decreasing their time spent in transition even more.

When transitioning to the cycling stage, whether from a swim, run, etc., there are generally two methods used, ignoring the assorted more minor variations. The first method is generally considered a beginner method. In this method, before the race the athlete lays out cycling shoes and optionally socks on the ground in the transition area next to the bicycle, helmet, and any other desired items. In the race, the athlete first puts on the helmet, the shoes and/or socks in the transition area, grabs the bicycle, and then runs out of the transition area. Once in the bicycle mounting area, the athlete sits or hops onto the bicycle, clips in or otherwise places the shoes on the pedals, and takes off, thereby beginning the cycling stage. The shoes themselves can be any type of shoe, from running shoes and clipless cycling shoes, to triathlon specific cycling shoes.

The second method is generally considered a more advanced method. In this method, the athlete uses clipless cycling shoes that have a cleat can be clipped in or attached to the bicycle pedals. The clipless cycling shoes are attached to the pedals and then a breakable device is wrapped around or attached to the shoe and some part of the bicycle. The breakable device is commonly a rubber-band, but can also be string, floss, thread, wire, etc.

In the race, the athlete does not need to stop and put on the shoes. Instead the athlete only needs to put on the helmet, grab the bicycle, and run with them out of the transition area. Then in the mounting area, the athlete sits or hops onto the bicycle and places their feet on top of the shoes. The athlete is then able to pedal up to speed before slipping the feet into the shoes as the rubber band will easily break when the athlete begins to pedal. This second method has been found to be a faster way of transitioning to the bicycle stage.

Figure 1:
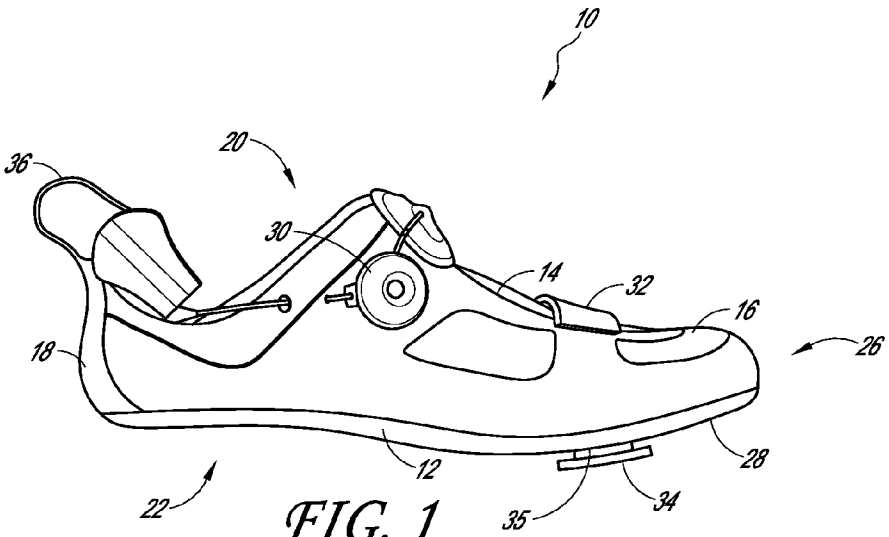

Certain multi-sport cycling shoes will now be described in more detail. FIGS. 1 and 2 illustrate two different styles of triathlon shoes. FIG. 1 shows a triathlon shoe 10 generally used for the cycling stage in a triathlon. The triathlon shoe 10 can have a sole 12, including an insole and an outsole. The outsole can be made of various materials such as a carbon/glass fiber reinforced outsole, or an injection-molded and glass-reinforced outsole. The shoe can also have an upper 14 that is attached to the sole 12. The upper may or may not include a tongue. The shoe also has a toe 16 and a heel 18, corresponding to the front and back of the shoe respectively. The shoe can also have a top 20, a bottom 22, and two sides 24, 26. The sides can be an inseam or arch side 24 and an outer seam side 26. FIG. 1 illustrates the outer seam side 26. A cleat 34 can be attached to the shoe on the bottom 22 near the ball of the foot region 28. The bottom of the shoe can include one or more screw holes 35 to receive a screw so that the cleat can be attached to the shoe.

FIG. 2 is a mountain bike triathlon shoe 10' generally used with a mountain bike for off-road triathlons. One difference between the two shoes being the presence of tread 15 at the toe 16 and around the ball of the foot 28 on the mountain bike triathlon shoe. The tread 15 can be thermoplastic replaceable tread and may include an internally recessed bolt that allows for the replacement of the tread.

A multi-sport cycling shoe can include a tightening system 30. The tightening system 30 can be one or more of a lacing system, at least one buckle, at least one strap, including VELCRO® (hook and loop fasteners) straps, a self-contained band and reel system, etc. FIG. 1 illustrates a tightening system 30 that includes a self-contained band and reel system, as well as a VELCRO® (hook and loop fasteners) strap 32. One example of a self-contained band and reel system is the BOA CLOSURE SYSTEM®, available from Boa Technology Inc. of Steamboat Springs, Colo. The mountain bike triathlon shoe 10' of FIG. 2 has two VELCRO® (hook and loop fasteners) straps 32.

A lacing system may include elastic laces configured to be secured without tying such as QUICK LACE®, available from Zoot Sports of Seattle, Wash., or YANKZ® elastic laces, from Sporting Innovations Group LLC of Atlanta, Ga.

In some preferred embodiments, the shoe does not have laces, or does not have laces for tying in a knot or bow, but rather has another type of tightening system. In some preferred embodiments, the shoe includes at least one strap 32, such as a VELCRO® (hook and loop fasteners) strap. A VELCRO® or hooks and loops strap can beneficially be easily adjusted and secured while on a bicycle. Also, the straps are less likely to interfere with the moving parts of the bicycle as compared to laces. In another preferred embodiment, the shoe includes a self-contained band and reel system. These systems can also be easily adjusted and are also less likely to interfere with the moving parts of the bicycle.

A multi-sport cycling shoe can also include a loop or heel pull 36. The heel pull 36 can more easily allow the user to get the shoe on the foot as desired. In particular, the heel pull 36 can help to ensure that the heel 18 of the shoe does not get stuck under the heel of the user's foot. The shoe 10 may also include features such as smooth internal lining for "sockless" riding fit and comfort. Other features can include tread 15 at the heel. The tread can be thermoplastic replaceable heel tread with an internally recessed bolt.

As has been discussed, a multi-sport cycling shoe can include a hook, clip, clasp, catch, or other device on the shoe which can be used together with another device, such as with a rubber band, rope, string, thread, wire, etc., to position the shoes on a bicycle in a desired position. The shoe cleats can be clipped into pedals on the bicycle, and the hook and rubber band can be used to position the shoes and crank arms of the bicycle in the position desired by the user. In addition, in some embodiments, only one of the shoes of the pair may include a hook.

Figure 3:
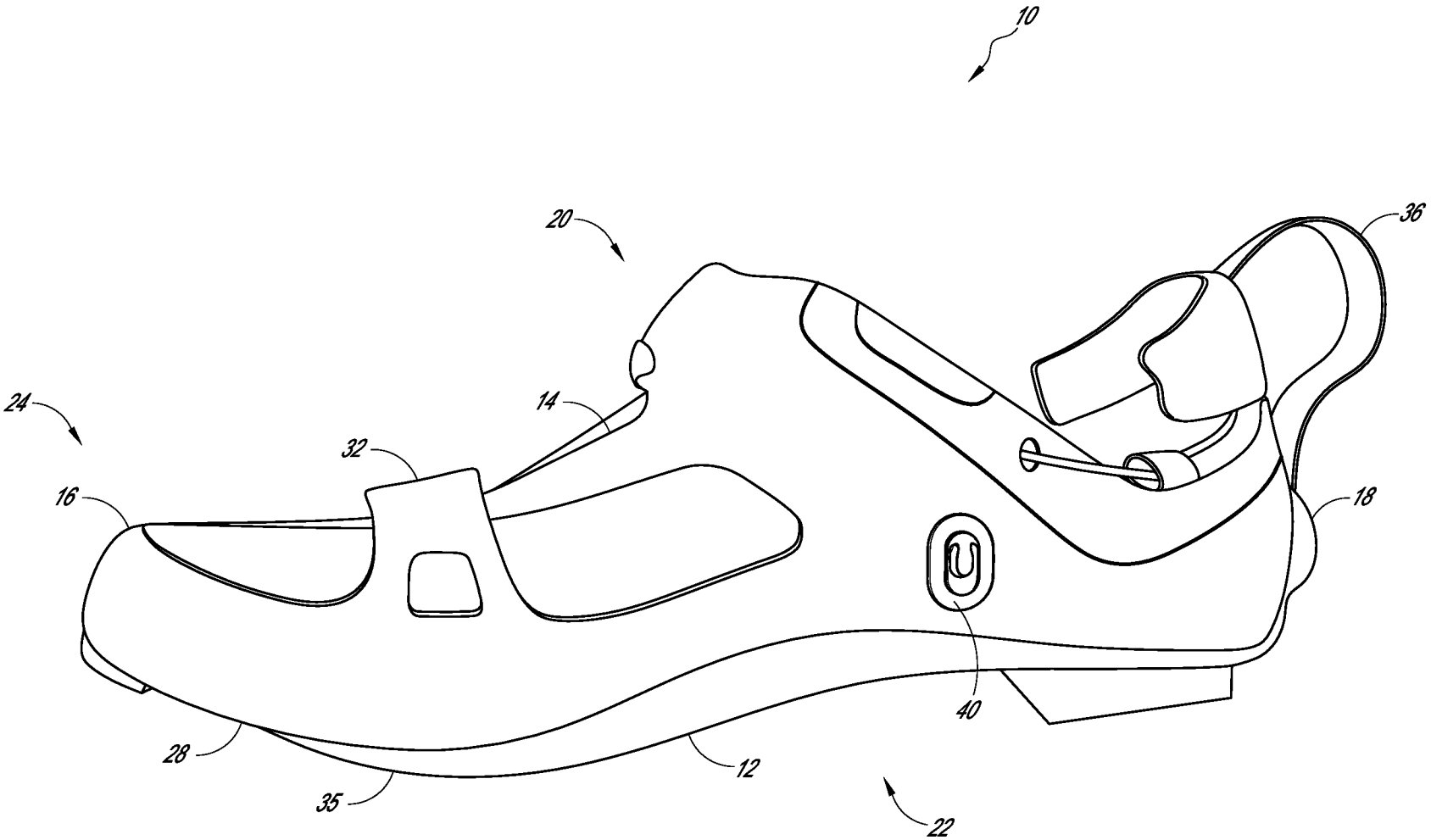
FIGS. 3 and 4 illustrate an inseam or arch side of different shoes.
Figure 4:
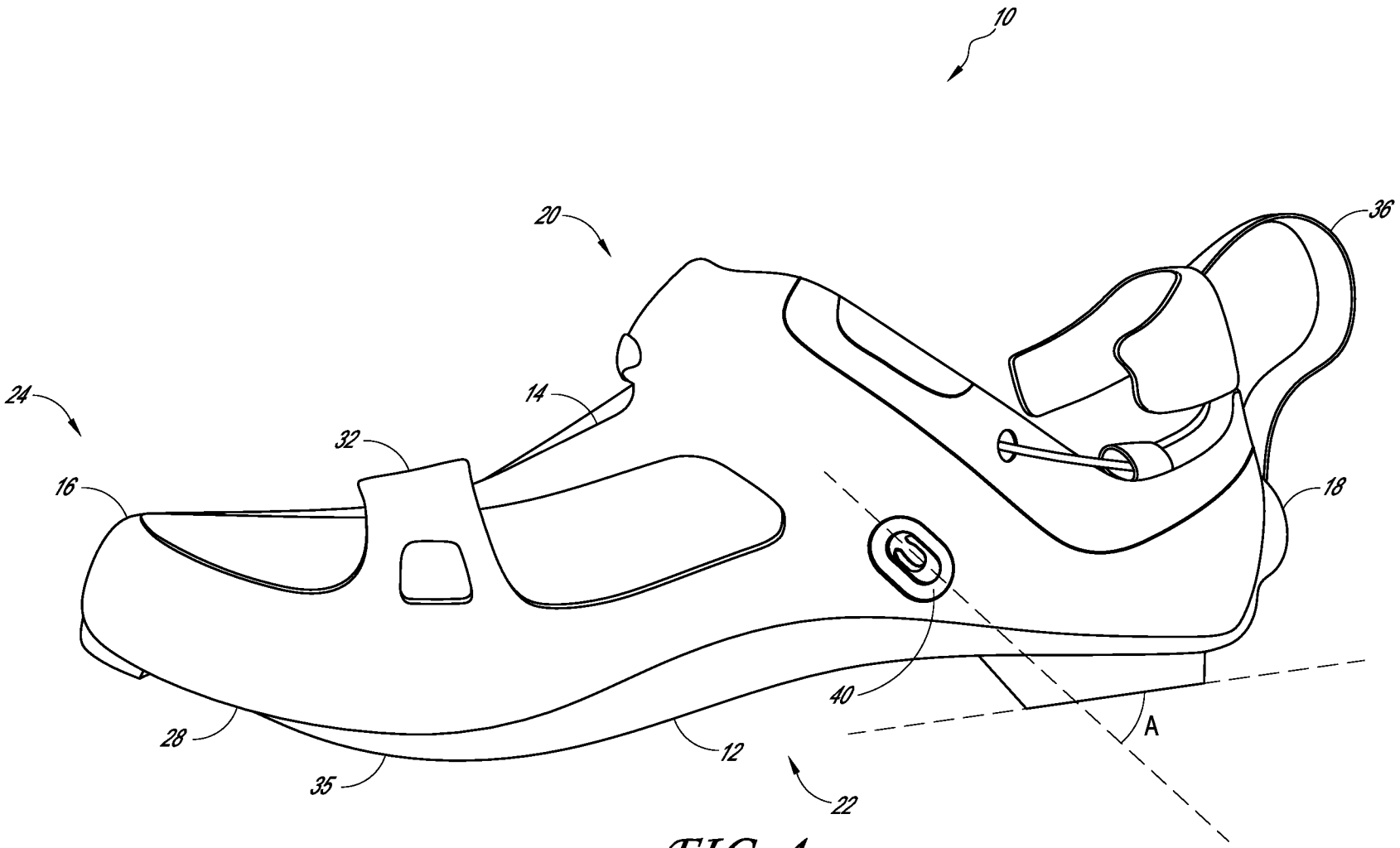

Turning now to FIGS. 3 and 4, arch side views 24 of the triathlon shoes 10, 10" are shown. In this view, the hook 40 can be seen. FIGS. 3 and 4 illustrate the hook 40 in two different orientations. The hook 40 can be attached to the upper and/or sole of the shoe through many ways, such as being sewn, glued, and/or welded to the shoe.

In FIG. 3, the hook 40 is essentially vertical with the hook 40 pointing downward. In FIG. 4, the hook 40 is pointing downward and back towards the heel 18. The hook 40 can be orientated in one of many different configurations. For example, the hook can be angled "A" from the vertical or horizontal positions. As shown, the hook 40 of FIG. 4 is approximately 45 degrees from the horizontal or vertical positions. In some embodiments the hook can point upwards or downwards and be angled towards the toe or heel at approximately: 10, 15, 20, 30, 45, 60, and 90 degrees.

Figure 5:
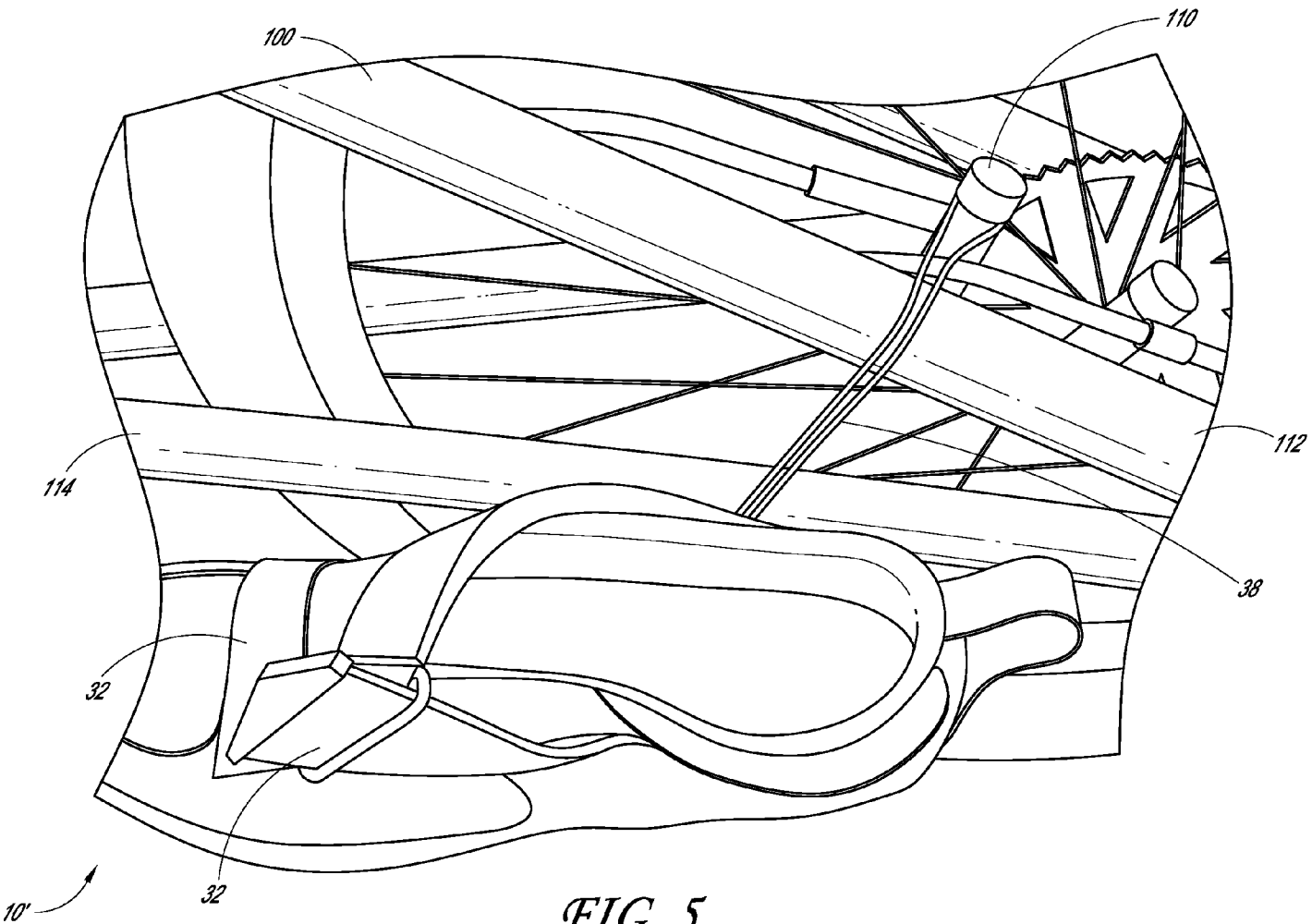
FIG. 5 shows a triathlon cycling shoe attached to a bicycle.
Figure 6:
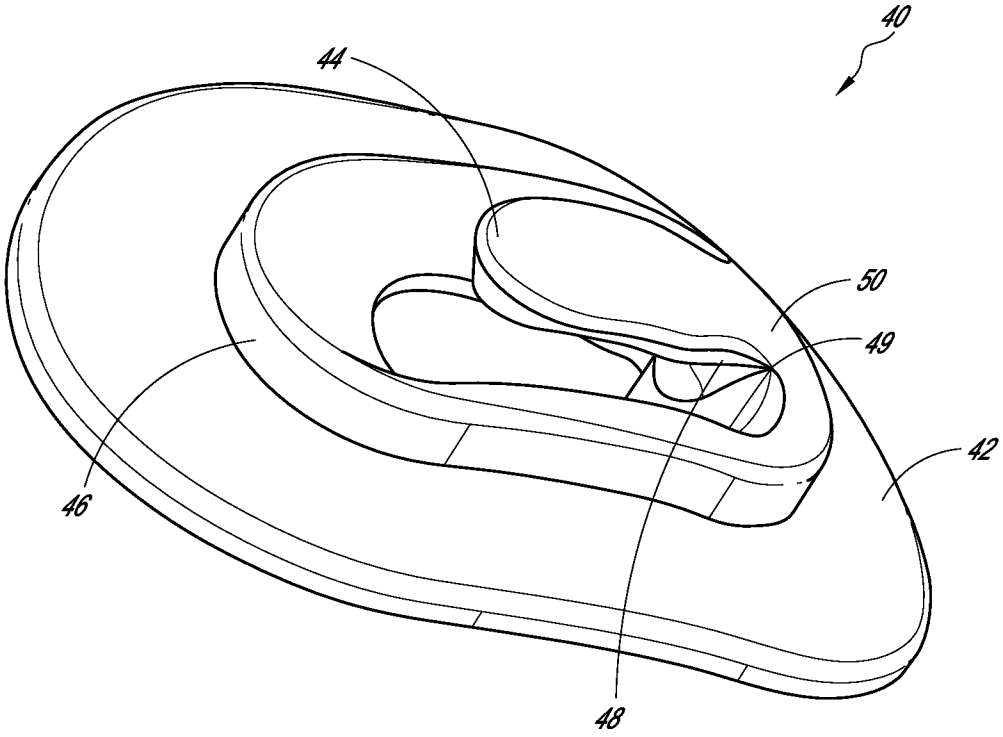
FIG. 6 is a perspective view of a hook that can be used on a triathlon cycling shoe.
Figure 7:
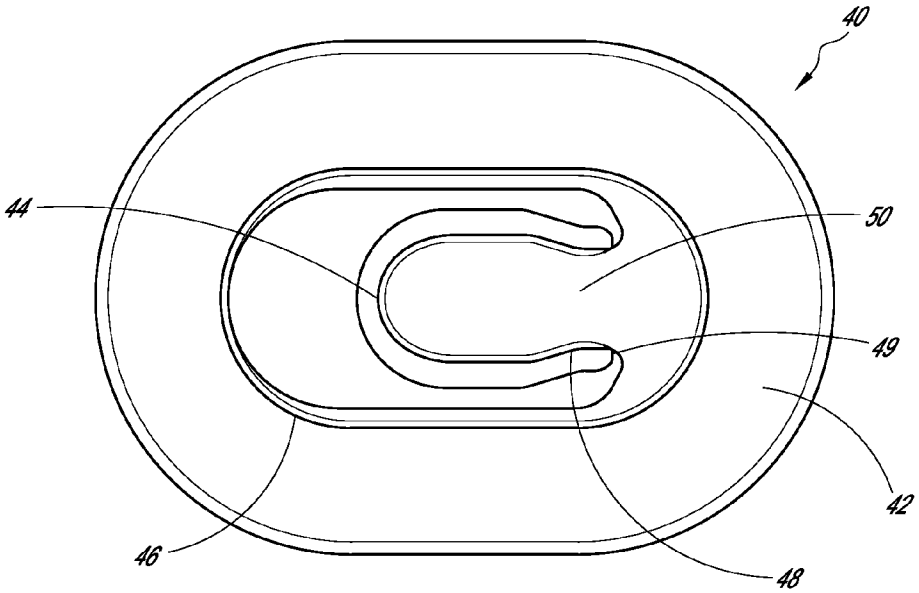
FIG. 7 is a front view of the hook of FIG. 6.
Figure 9:
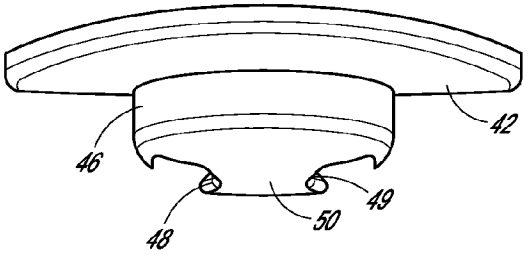
FIG. 9 is a top view of the hook of FIG. 6.
Figure 8:
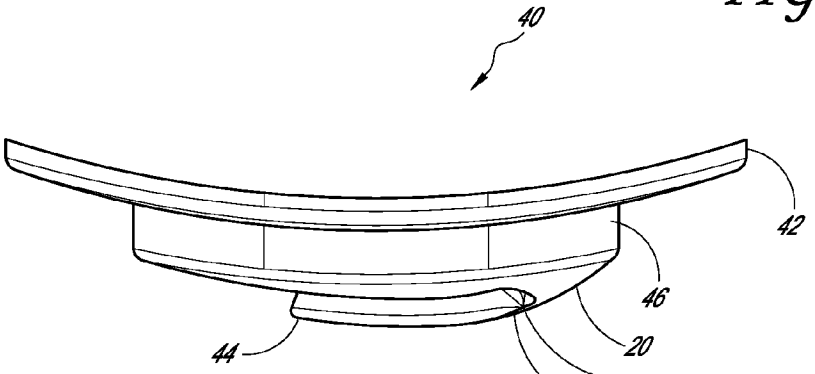
FIG. 8 is a first side view of the hook of FIG. 6, the second side being a mirror image.
Figure 11:
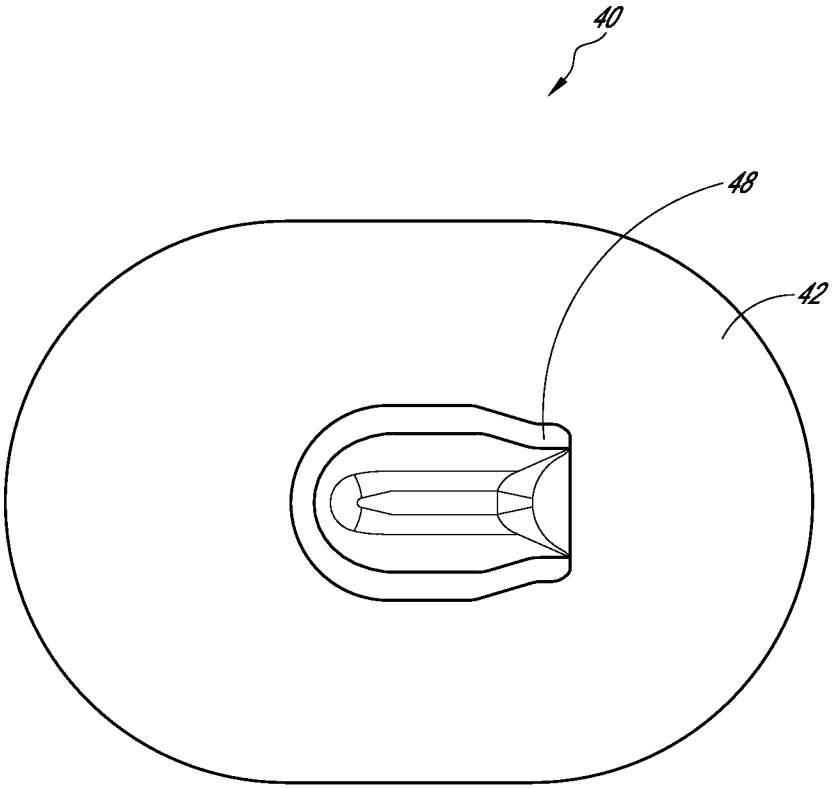
FIG. 11 is a back view of the hook of FIG. 6.
Figure 10:
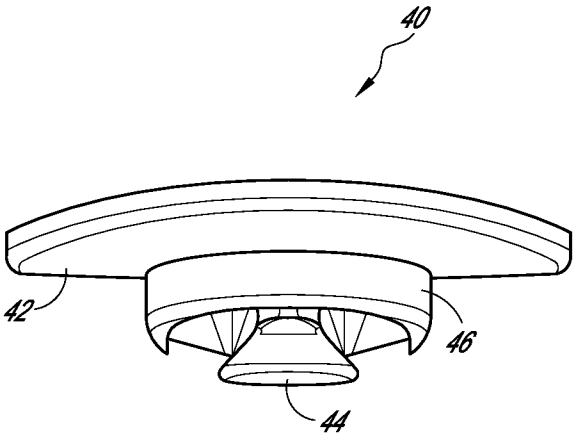
FIG. 10 is a bottom view of the hook of FIG. 6.
Figure 12:
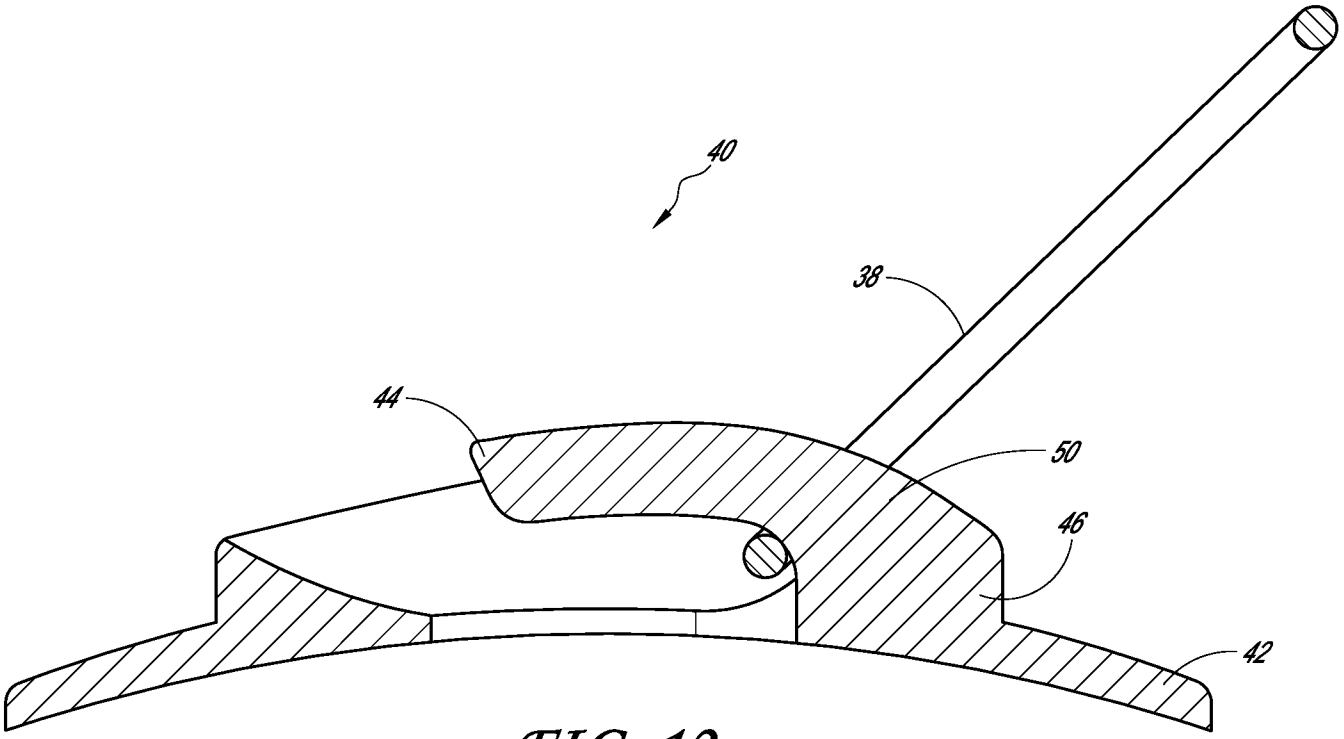
FIG. 12 illustrates a schematic cross-section of the hook of FIG. 6.

It can be seen that the hook 40 in both FIGS. 3 and 4 is positioned closer to the heel 18 and spaced from the toe 16 and the ball of the foot region 28 where the cleat 34 connects to the shoe. The cleat 34 and the hook 40 can establish two points of contact between the shoe and a bicycle. Spacing these two points of contact away from one another on the shoe can beneficially provide more control over the positioning of the shoe with respect to the bicycle. This can allow, for example, the shoe to be positioned substantially level. As most pedals are designed to spin, having the points of contact spaced from one another reduces the tendency of the shoe to spin on the pedal and the tendency of the combined shoe, pedal, and crank arm to move downward. FIG. 5 illustrates the shoe 10' connected to a bicycle 100 at the pedal and with a rubber band 38. The rubber band 38 is wrapped around a portion of a fluid reservoir 110 of a shock absorber. The rubber band 38 can also be attached to a bicycle in other ways. For example, the rubber band 38 can be wrapped around the seat stay 112 or the chain stay 114. The rubber band can be wrapped around and one end passed through the other to secure to the seat or chain stay. The loose end can then be attached to the hook 40. The rubber band could also be attached to other parts of the bicycle frame, such as the down tube or seat tube.

One embodiment of the hook 40 is shown in FIGS. 6-12. The hook can have many different shapes. As shown, the hook 40 has a base 42 primarily for attaching to the shoe, such as at the shoe upper. The base can be sewn, glued, welded, or otherwise attached to the shoe. The base can increase the surface area of the hook that engages the shoe, so that forces required to break the rubber band are distributed across a wide surface.

The free end 44 of the hook can be located in a central region 46. As shown, the central region 46 is also raised from the base 42. This can allow the central region 46 to be flush with or similar in depth to the outer surface of the shoe. For example, the base 42 can be sandwiched between two layers of fabric and the central region can protrude through a hole to the outside of the shoe.

As has been mentioned, the hook can take one of many different shapes. The hook can be shaped to help the rubber band or other device remain secure within the hook. In some embodiments, the hook 40 can include a ridge, groove, slot, indentation, or space 48 at the bend 50 of the hook. This ridge, groove, slot, indentation, or space 48 can be configured to receive a rubber band or other breakable member. This can allow the rubber band to slip into the groove 48 on the hook and be less inclined to slip off or down. As shown, the groove 48 is at the sides of the hook. The groove or other feature 48 can surround all or a portion of the hook, such as being on the underside of the hook and/or the sides of the hook.

In some embodiments, the ridge, groove, slot, indentation, or space 48 or another feature of the hook can come to a point or have a sharp edge 49. This can be used to cut or facilitate the breakage of the rubber band or other breakable member. For example, pedaling can cause the rubber band to be forced into contact with the sharp edge cutting the rubber band. In some embodiments, the hook can be shaped and positioned so that the rubber band will simply slide off the hook once pedaling starts but not beforehand.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A clipless cycling shoe for use in a multi-sport event comprising:

an arch side;

an outer side;

a heel having a heel pull;

a self-contained band and reel tightening system configured for bringing the arch side of the shoe in closer proximity to the outer side of the shoe by tightening the shoe around a foot of the user;

a single hook on the arch side of the shoe including a base and a free end of the hook and a bend opposite the free end, the hook defining a space between the base and the free end, a sharpened edge disposed at the bend and the bend receives the rubber band to facilitate the sharpened edge cutting the rubber band upon a pedaling motion with the shoe, the hook being separate from and spaced from the tightening system and the heel pull; and a breakable rubber band attached to the hook and separate from the tightening system;

wherein the hook is configured to engage the rubber band when the rubber band is attached to a bicycle.

2. The clipless cycling shoe of claim 1, further comprising a screw hole on a bottom of the shoe for receiving a screw to attach a cleat to the shoe.

3. The clipless cycling shoe of claim 2, further comprising the cleat.

4. The clipless cycling shoe of claim 1, wherein the shoe is configurable between a first position and a second position;

wherein the hook engages the rubber band in the first position and the band and reel tightening system is configured in an unfastened state such that the arch side of the shoe is spaced from the outer side so that a user may insert his foot into the shoe; and wherein the band and reel tightening system is engaged in the second position such that the arch side of the shoe is in closer proximity to the outer side of the shoe than in the first position and the band and reel tightening system is configured to secure the shoe around the foot of the user.

5. A clipless cycling shoe for use in a multi-sport event comprising:

an arch side;

an outer side;

a heel having a heel pull;

a tightening system including a first strap having hook and loop fasteners to secure the first strap, the tightening system configured for bringing the arch side of the shoe in closer proximity to the outer side of the shoe by tightening the shoe around a foot of the user;

a single hook on the arch side of the shoe including a base and a free end of the hook and a bend opposite the free end, the hook defining a space between the base and the free end, and a sharpened edge disposed at the bend and the bend receives the rubber band to facilitate the sharpened edge cutting the rubber band upon a pedaling motion with the shoe, the hook being separate from and spaced from the tightening system and the heel pull; and a breakable rubber band attached to the hook and separate from the tightening system;

wherein the hook is configured to engage the rubber band when the rubber band is attached to a bicycle.

6. The clipless cycling shoe of claim 5, wherein the tightening system includes a second strap having hook and loop fasteners to secure the second strap.

7. The clipless cycling shoe of claim 5, further comprising a screw hole on a bottom of the shoe for receiving a screw to attach a cleat to the shoe.

8. The clipless cycling shoe of claim 7, further comprising the cleat.

9. The clipless cycling shoe of claim 5, wherein the shoe is configurable between a first position and a second position;

wherein the hook engages the rubber band in the first position and the first strap is configured in an unfastened state such that the arch side of the shoe is spaced from the outer side so that a user may insert his foot into the shoe; and wherein the first strap is engaged in the second position such that the arch side of the shoe is in closer proximity to the outer side of the shoe than in the first position and the first strap is configured to secure the shoe around the foot of the user.

* * * * *